US012137866B2

(12) United States Patent
Yang et al.

(10) Patent No.: US 12,137,866 B2
(45) Date of Patent: Nov. 12, 2024

(54) SURFACE CLEANING APPARATUS

(71) Applicant: SHARKNINJA OPERATING LLC, Needham, MA (US)

(72) Inventors: Robert Yang, Suzhou (CN); Patrick Cleary, Allston, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/389,049

(22) Filed: Jul. 29, 2021

(65) Prior Publication Data

US 2022/0031134 A1 Feb. 3, 2022

Related U.S. Application Data

(60) Provisional application No. 63/058,395, filed on Jul. 29, 2020.

(51) Int. Cl.

| | |
|---|---|
| ***A47L 9/14*** | (2006.01) |
| ***A47L 5/24*** | (2006.01) |
| ***A47L 9/10*** | (2006.01) |

(52) U.S. Cl.

CPC ..... *A47L 9/1463* (2013.01); *A47L 9/106* (2013.01); *A47L 9/1481* (2013.01); *A47L 9/149* (2013.01); *A47L 5/24* (2013.01)

(58) Field of Classification Search

CPC ..... A47L 9/1463; A47L 9/106; A47L 9/1481; A47L 9/149; A47L 5/24; A47L 9/1427; A47L 9/1683; A47L 9/1691

See application file for complete search history.

(56) References Cited

U.S. PATENT DOCUMENTS

| | | | | |
|---|---|---|---|---|
| 5,107,567 | A * | 4/1992 | Ferrari | A47L 5/28 55/300 |
| 5,659,922 | A * | 8/1997 | Louis | A47L 9/1409 403/321 |
| 6,317,921 | B1 * | 11/2001 | Park | A47L 9/1409 15/351 |
| 7,412,749 | B2 * | 8/2008 | Thomas | A47L 5/225 15/347 |
| 2009/0205491 | A1 * | 8/2009 | Eckstein | A47L 9/20 95/68 |
| 2018/0177366 | A1 * | 6/2018 | Conrad | A47L 9/1608 |
| 2019/0090701 | A1 * | 3/2019 | Tonderys | A47L 9/2884 |
| 2019/0282051 | A1 * | 9/2019 | Conrad | A47L 9/1608 |
| 2020/0037836 | A1 | 2/2020 | Paulla et al. | |

(Continued)

FOREIGN PATENT DOCUMENTS

| | | |
|---|---|---|
| CN | 209826545 | 12/2019 |
| JP | H04122336 | 4/1992 |

OTHER PUBLICATIONS

PCT Search Report and Written Opinion mailed Nov. 4, 2021, received in corresponding PCT Application No. PCT/US21/43751, 9 pages.

(Continued)

*Primary Examiner* — Steven M Cernoch
*Assistant Examiner* — Christopher Soto
(74) *Attorney, Agent, or Firm* — Grossman Tucker Perreault & Pfleger, PLLC

(57) ABSTRACT

A surface cleaning apparatus may include a cleaner body and a dust cup coupled to the cleaner body. The dust cup may be configured to pivot between at least three indexed positions.

8 Claims, 4 Drawing Sheets

(56) References Cited

U.S. PATENT DOCUMENTS

| | | | | |
|---|---|---|---|---|
| 2020/0230617 | A1 | 7/2020 | Conrad | |
| 2020/0253437 | A1* | 8/2020 | Conrad | A47L 9/1608 |
| 2021/0235947 | A1 | 8/2021 | Ni | |

OTHER PUBLICATIONS

Australian Examination Report issued Dec. 19, 2023, received in Australian Patent Application No. 2021316026, 3 pages.
Japanese Office Action with English language translation issued Dec. 26, 2023, received in Japanese Patent Application No. 2023-506278, 8 pages.
Canadian Office Action issued May 29, 2024, received in Canadian Patent Application No. 3,187,488, 3 pages.

* cited by examiner

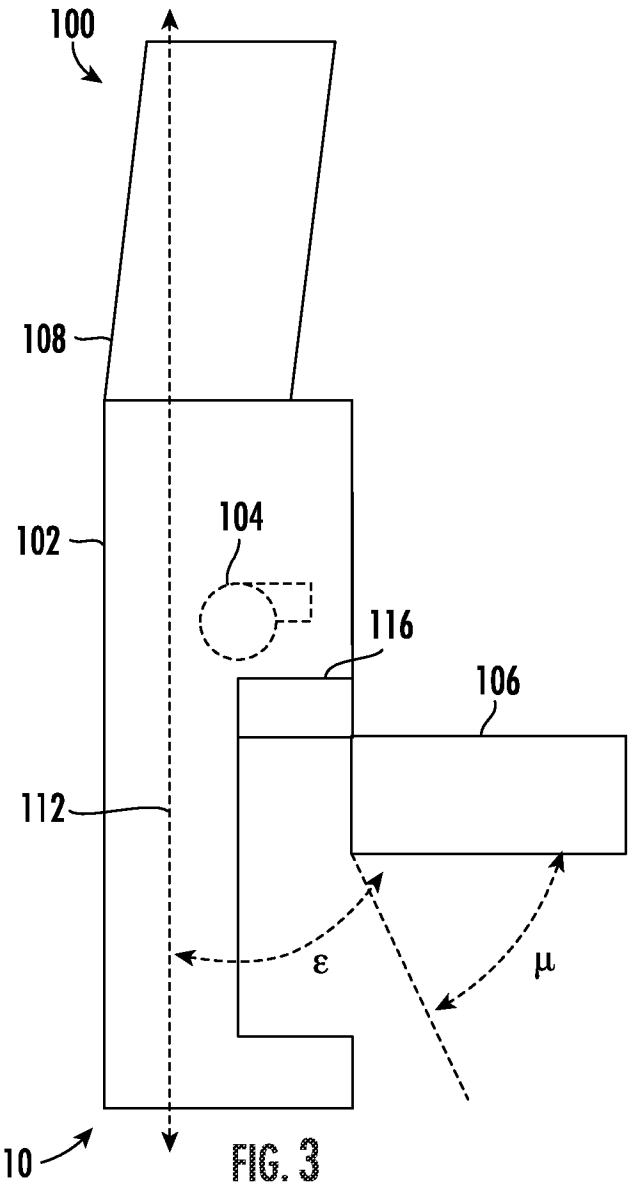
FIG. 1
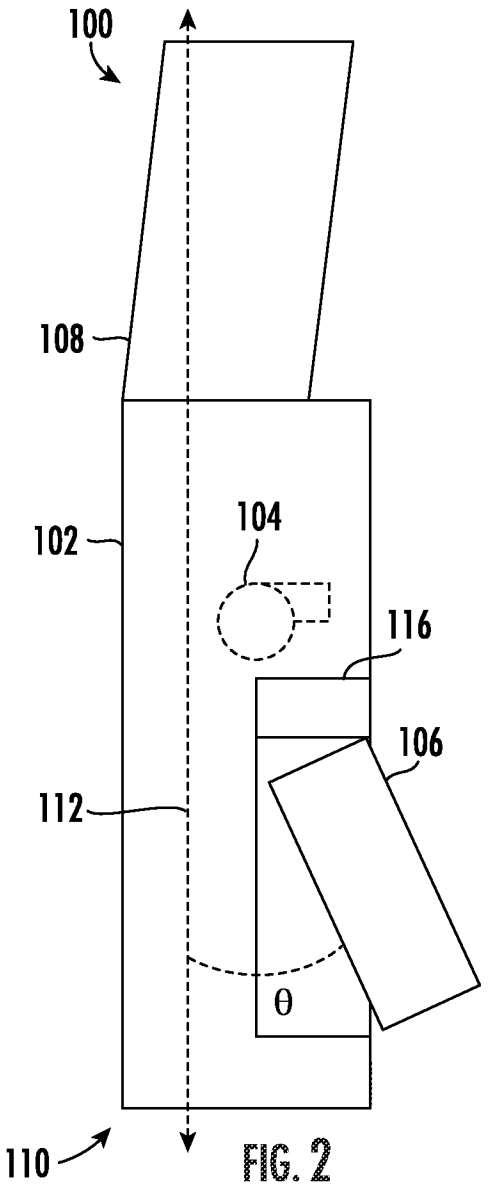
FIG. 2
FIG. 3

SURFACE CLEANING APPARATUS

CROSS-REFERENCE TO RELATED APPLICATIONS

The present application claims the benefit of U.S. Provisional Application Ser. No. 63/058,395 filed on Jul. 29, 2020, entitled Surface Cleaning Apparatus, which is fully incorporated herein by reference.

TECHNICAL FIELD

The present disclosure is generally related to surface cleaning apparatuses and more specifically related to vacuum cleaners.

BACKGROUND INFORMATION

Surface cleaning apparatuses can include vacuum cleaners. Vacuum cleaners may include a suction motor, a dust cup, and an inlet. The suction motor is fluidly coupled to the dust cup and the inlet such that air can flow from the inlet into the dust cup and through the suction motor. Air flowing into the dust cup may have debris entrained therein. At least a portion of the entrained debris may fall out of entrainment when passing through the dust cup.

One example of a vacuum cleaner may be an upright vacuum cleaner. An upright vacuum cleaner may include a surface cleaning head and an upright section, wherein the upright section is pivotally coupled to the surface cleaning head. The upright section is configured to pivot between a storage position and an in-use position. Another example of a vacuum cleaner may be a handheld vacuum cleaner that is configured to be supported in the hand of a user independently from a surface to be cleaned. As such, a handheld vacuum cleaner may be more maneuverable when compared to an upright vacuum cleaner.

BRIEF DESCRIPTION OF THE DRAWINGS

These and other features and advantages will be better understood by reading the following detailed description, taken together with the drawings, wherein:

FIG. 1 is schematic view of an example of a surface cleaning apparatus, consistent with embodiments of the present disclosure.

FIG. 2 is a schematic view of the surface cleaning apparatus of FIG. 1 having a dust cup in an emptying position, consistent with embodiments of the present disclosure.

FIG. 3 is a schematic view of the surface cleaning apparatus of FIG. 1 having a dust cup in a removal position, consistent with embodiments of the present disclosure.

DETAILED DESCRIPTION

Figure 4:
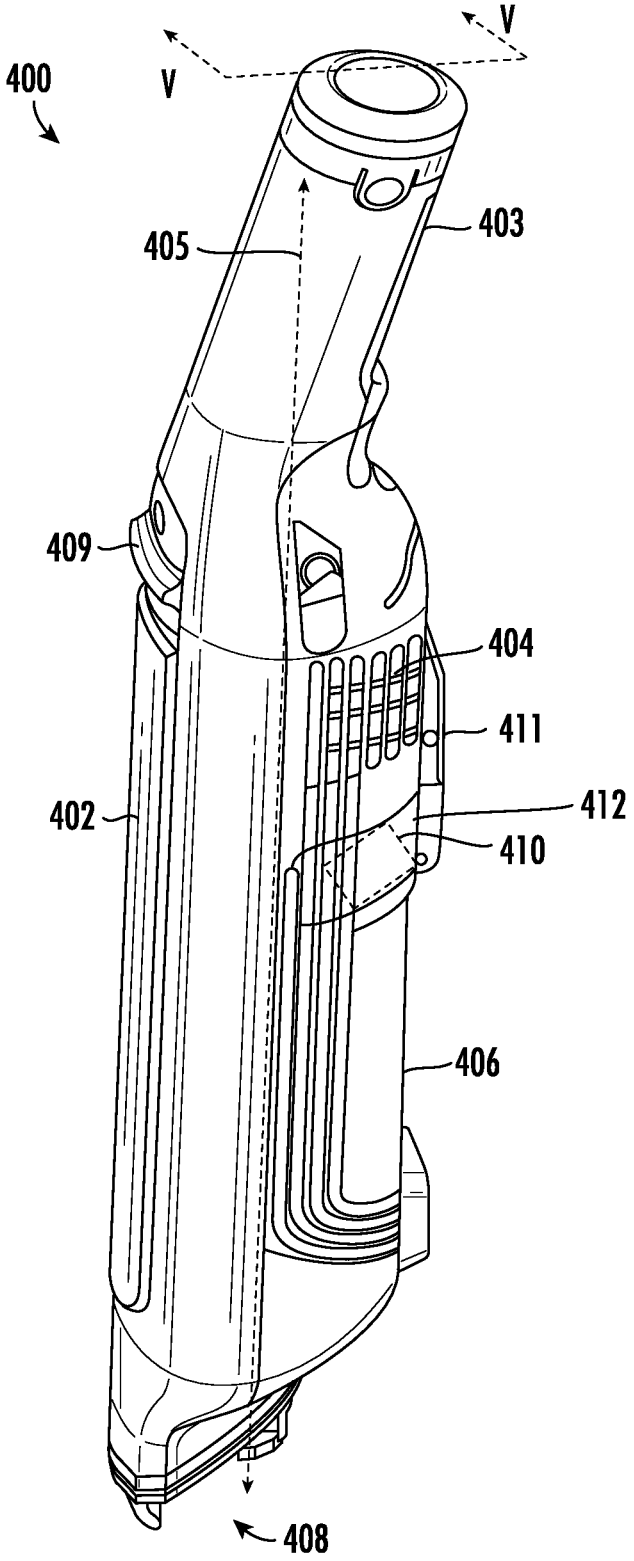
FIG. 4 is a perspective view of a vacuum cleaner, consistent with embodiments of the present disclosure.

The present disclosure is generally related to a surface cleaning apparatus. The surface cleaning apparatus may include a cleaner body, a suction motor, and a dust cup. The cleaner body defines an air inlet fluidly coupled to the dust cup and the suction motor. The suction motor is configured to draw air along an air flow path that extends from the air inlet into the dust cup and through the suction motor. Air flowing along the air flow path may have debris entrained therein. At least a portion of the entrained debris may fall out of entrainment when passing through the dust cup. The dust cup is removably and/or pivotally coupled to the cleaner body such that the dust cup pivots between at least three indexed positions. For example, the dust cup can be configured to pivot from a closed position toward an emptying position and from the emptying position toward a removal position. When in the emptying position, debris within the dust cup may be removed therefrom. When in the removal position, the accessibility of one or more components of the surface cleaning apparatus may be improved relative to the emptying position (e.g., for purposes of cleaning and/or maintenance).

FIG. 1 shows a schematic example of a surface cleaning apparatus 100. As shown, the surface cleaning apparatus 100 includes a cleaner body 102, a suction motor 104 (shown in hidden lines), and a dust cup 106. The cleaner body 102 includes a handle 108 and an inlet 110. The inlet 110 is opposite the handle 108 along a longitudinal axis 112 of the cleaner body 102. The suction motor 104 is fluidly coupled to the inlet 110 and the dust cup 106. The suction motor 104 is configured to draw air into the inlet 110 along an air flow path 114. As shown, the air flow path 114 extends from the inlet 110 into the dust cup 106 and through the suction motor 104 before being exhausted into a surrounding environment. Air flowing along the air flow path 114 may have debris entrained therein. As such, as the air passes through the dust cup 106, at least a portion of the entrained debris may be deposited in the dust cup 106 for later disposal.

The dust cup 106 is pivotally and/or removably coupled (e.g., directly or indirectly) to the cleaner body 102. In some instances, the dust cup 106 can be configured to pivot between a closed position and at least one open position. For example, the dust cup 106 can be pivotally coupled to the cleaner body 102 such that the dust cup 106 can pivotally transition between at least three indexed positions (e.g., a closed position, a first open position, and a second open position). The dust cup 106 can be configured to be selectively retained (e.g., by a user actuatable release) at each indexed position.

The first position may generally be described as a closed position. When in the closed position, the dust cup 106 is fluidly coupled to the inlet 110. An example of the closed position is shown in FIG. 1.

The second position may generally be described as a first open position (e.g., an emptying position). When the dust cup 106 transitions from the closed position to the emptying position, the dust cup 106 pivots through an empty angle θ. The empty angle θ may measure, for example, in a range of 30° to 70°. By way of further example, the empty angle θ may measure substantially (e.g., within 1°, 2°, 3°, 4°, or 5° of) 50°. An example of the emptying position is shown in FIG. 2. When in the emptying position, the dust cup 106 is fluidly decoupled from the inlet 110 and the empty angle θ may be measured between the longitudinal axis 112 of the cleaner body 102 and the dust cup 106.

The third position may generally be described as a second open position (e.g., a removal position). When the dust cup 106 transitions from the emptying position to the removal position, the dust cup 106 pivots through a removal angle μ. For example, the removal angle μ may measure in a range of 30° to 50°. By way of further example, the removal angle μ may measure substantially (e.g., within 1°, 2°, 3°, 4°, or 5° of) 40°. When measured from the longitudinal axis 112, a total removal angle ε measures greater than the empty angle θ. For example, the total removal angle ε may measure in a range of 70° to 110°. By way of further example, the total removal angle ε may measure substantially (e.g., within 1°, 2°, 3°, 4°, or 5° of) 90°. An example of the removal position is shown in FIG. 3.

In some instances, a removable part 116 is removably coupled to the cleaner body 102. The dust cup 106 may be pivotally coupled to the removable part 116. As such, the dust cup 106 and removable part 116 may be removed from the cleaner body 102 together. For example, when the dust cup 106 is transitioned to the emptying position or the removal position, the dust cup 106 and removable part 116 may be removed from the cleaner body 102. As such, the dust cup 106 can be configured to transition to the removal position after the dust cup 106 and removable part 116 are separated from the cleaner body 102. The removable part 116 may define a filter chamber for receiving a filter and may be fluidly coupled to the suction motor 104. Examples of filters include, but are not limited to, cyclonic filters, mesh filters, pleated filters, and/or any other type of filter.

When the dust cup 106 has a closed position, an emptying position, and a removal position, cleaning of the dust cup 106 may be easier (when compared to a dust cup having only, for example, a closed position and only one of an emptying position or a removal position). For example, such a configuration may reduce a plumage of debris when emptying the dust cup 106 while still allowing for easy access to clean at least a portion of the dust cup 106. Debris plumage may generally be described as debris that is scattered into the environment as a result of emptying of the dust cup 106.

FIG. 4 shows a perspective view of a vacuum cleaner 400, which may be an example of the surface cleaning apparatus 100 of FIG. 1. The vacuum cleaner 400 includes a cleaner body 402, a suction motor 404, and a dust cup 406. The cleaner body 402 can include a handle 403 and an inlet 408. The suction motor 404 may be disposed within a suction motor cavity defined within the cleaner body 402 and the dust cup 406 can be pivotally and/or removably coupled to the cleaner body 402. As shown, the suction motor 404 and the dust cup 406 can be disposed between the handle 403 and the inlet 408 of the cleaner body 402. For example, the dust cup 406 may be disposed between the inlet 408 and the suction motor 404 and the suction motor 404 may be disposed between the dust cup 406 and the handle 403. In this example, at least a portion of the suction motor 404 may overlap (e.g., a longitudinal axis 405 of the cleaner body 402 intersects with the suction motor 404 and) with at least a portion of the dust cup 406 and/or at least a portion of the handle 403.

The suction motor 404 is configured to draw air in through an inlet 408 and into the dust cup 406 before passing through the suction motor 404. As such, the suction motor 404 can be generally described as being fluidly coupled to the dust cup 406 and the inlet 408. Air flowing through the inlet 408 may have debris entrained therein. At least a portion of the entrained debris may be deposited in the dust cup 406.

The dust cup 406 may, for example, be configured to cause air flowing therethrough to flow according to a cyclonic motion, generating one or more cyclones. Cyclonic motion of the air may urge at least a portion of the entrained debris out of entrainment as a result of the cyclonic motion. In some instances, the dust cup 406 may be configured such that a plurality of cyclones are generated, wherein a first cyclone is configured to separate large debris from the air and the second cyclone is configured to separate small debris from the air. In this instance, the dust cup 406 may generally be described as being a multi-stage cyclonic dust cup.

The dust cup 406 may be pivotal between a closed position and at least one open position, wherein the dust cup 406 can be removed from the cleaner body 402 when in an open position. For example, the dust cup 406 can be configured to pivot from a closed position to an emptying position and, in some instances, from the emptying position to a removal position. The dust cup 406 can be configured to be selectively retained at each position using one or more of, for example, actuatable latches, slidable stops, detents, and/or any other retaining feature. As such, the dust cup 406 can generally be described as being pivotable between two or more (e.g., at least three) indexed positions (e.g., the closed position and at least one open position).

In some instances, actuation of an emptying release 409 may allow the dust cup 406 to transition from the closed position (a first indexed position) to the emptying position (a second indexed position) and actuation of a removal release 411 may allow the dust cup 406 to transition from the emptying position to the removal position (a third indexed position). For example, the dust cup 406 can be pivotally coupled to a removable part 412 (e.g., a removable premotor filter chamber) that is removably coupled to the cleaner body 402, wherein actuation of the removal release 411 allows the removable part 412 to be decoupled from the cleaner body 402. The removable part 412 may be decoupled from the cleaner body 402 with dust cup 406 in either the emptying position or the removal position. As such, in some instances, the dust cup 406 may be pivoted to the removal position after the dust cup 406 and removable part 412 are decoupled from the cleaner body 402.

A premotor filter 410 (shown schematically in hidden lines) may be fluidly coupled to the dust cup 406 and the suction motor 404 such that air passes through the premotor filter 410 after exiting the dust cup 406 and before passing through the suction motor 404. The premotor filter 410 may capture at least a portion of any debris entrained within the air after passing through the dust cup 406. For example, the premotor filter 410 may be disposed within the premotor filter chamber 412, the premotor filter chamber 412 being disposed between the dust cup 406 and the suction motor 404. In some instances, the dust cup 406 may define at least a portion of the premotor filter chamber 412.

Figure 5:
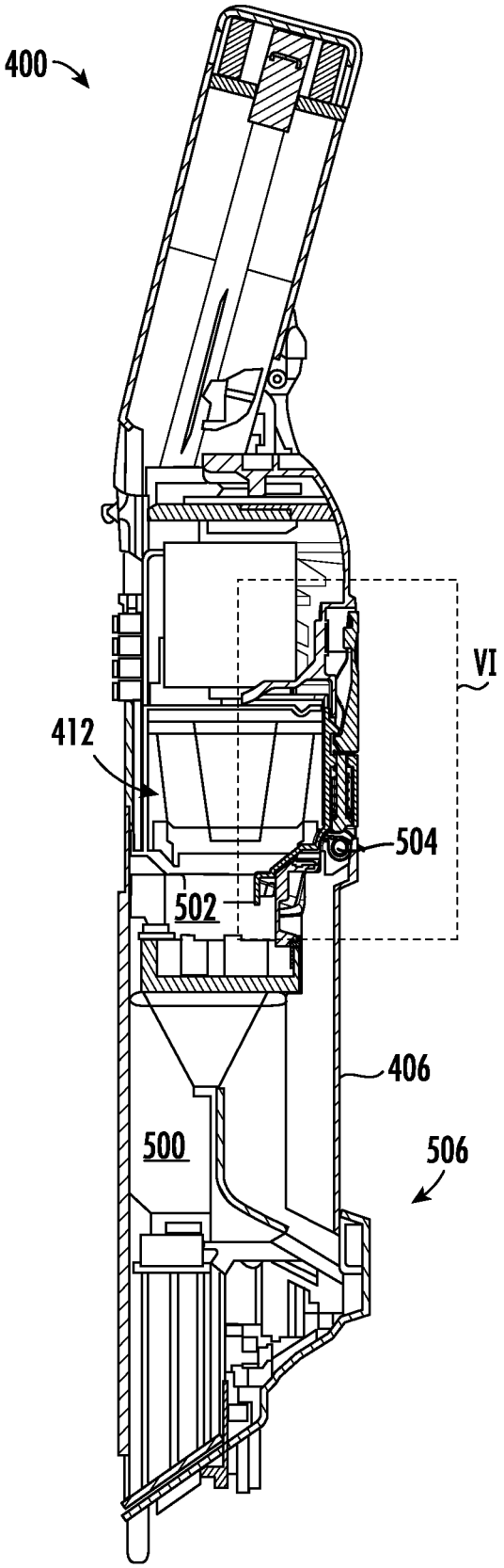
FIG. 5 is a cross-sectional view of the vacuum cleaner of FIG. 4 taken along the line V-V, consistent with embodiments of the present disclosure.

FIG. 5 is a cross-sectional view of the vacuum cleaner 400 of FIG. 4, taken along the line V-V. As shown, the dust cup 406 has a first stage 500 and a second stage 502. The second stage 502 is disposed between the first stage 500 and the premotor filter chamber 412. The first stage 500 may be configured to generate a first cyclone therein and the second stage 502 may be configured to generate a second cyclone therein. The first and second stages 500 and 502 may be fluidly coupled in series (e.g., air flows through the first stage 500 before flowing through the second stage 502).

As shown, the dust cup 406 is configured to pivot about a pivot point 504. The pivot point 504 is positioned between the second stage 502 and the suction motor 404. For example, the dust cup 406 may be pivotally coupled to the premotor filter chamber 412 such that the pivot point 504 corresponds to a point on the premotor filter chamber 412. When the dust cup 406 transitions from the closed position towards the emptying position, an inlet end 506 of the dust cup 406 pivots away from the cleaner body 402. Such a configuration may reduce debris plumage when emptying the dust cup 406. When the dust cup 406 is transitioned from the emptying position to the removal position, the second stage 502 may be more easily accessible (e.g., for cleaning one or more components of the second stage 502). For example, the second stage 502 may include one or more removable components (e.g., one or more removable components that are configured to encourage a cyclonic motion of air flowing therethrough) that are more easily removed when the dust cup 406 is in the removal position when compared to the emptying position. In some instances, the dust cup 406 may be pivoted to the removal position after the premotor filter chamber 412 and dust cup 406 have been removed from the cleaner body 402. Additionally, or alternatively, the dust cup 406 may be pivoted to the removal position while the premotor filter chamber 412 is coupled to the cleaner body 402.

Figure 6:
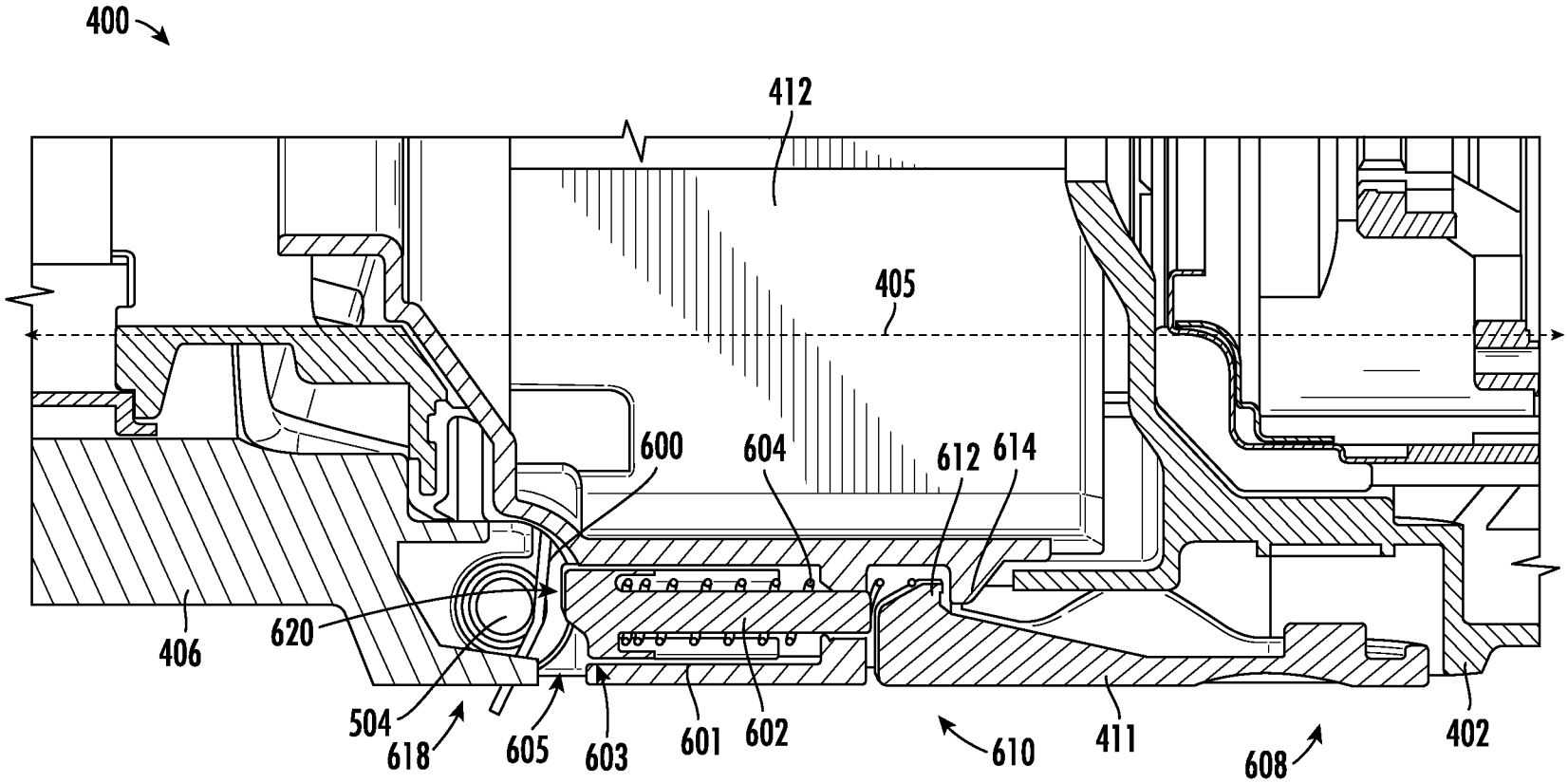
FIG. 6 is a magnified cross-sectional view of a portion of the vacuum cleaner of FIG. 4 corresponding to region VI of FIG. 5, consistent with embodiments of the present disclosure.

FIG. 6 shows a magnified cross-sectional view of the vacuum cleaner 400 generally corresponding to region VI of FIG. 5. As shown, the dust cup 406 is pivotally coupled to the premotor filter chamber 412 and the premotor filter chamber 412 is removably coupled to the cleaner body 402. As such, the dust cup 406 can generally be described as being pivotally and removably coupled to the cleaner body 402.

A dust cup biasing mechanism 600 (e.g., a spring, such as a torsion spring) is positioned at the pivot point 504. The dust cup biasing mechanism 600 is configured to urge the dust cup 406 toward the emptying position. As such, when the emptying release 409 is actuated, the dust cup 406 is moved toward the emptying position by the dust cup biasing mechanism 600.

When at the emptying position, the dust cup 406 engages a stop 602 configured to retain the dust cup 406 in the emptying position. The stop 602 can be slidably coupled to the premotor filter chamber 412 such that the stop 602 slides between a stopping position and a retracted position in response to pivotal movement of the dust cup 406 between the emptying position and the removal position. For example, the stop 602 can be slidably received within a track 601 defined in the premotor filter chamber 412. The track 601 can be at least partially enclosed and includes openings 603 at opposing ends of the track 601, wherein the openings 603 are configured to receive at least a portion of the stop 602. The openings 603 may have the same or different size and/or shape. A stop biasing mechanism 604 (e.g., a spring, such as a compression spring) urges the stop 602 toward the pivot point 504 (or stopping position). For example, the stop biasing mechanism 604 may urge the stop 602 along the track 601 in a direction of the pivot point 504. When the stop 602 is at the stopping position and the dust cup 406 is at the emptying position, the dust cup 406 engages the stop 602, wherein the stop 602 resists further pivotal movement of the dust cup 406. The stop 602 can define an arcuate region 605 configured to engage the dust cup 406 when the dust cup 406 is at the emptying position. The arcuate region 605 is configured such that engagement between the arcuate region 605 and the dust cup 406 urges the stop 602 in a direction away from the pivot point 504, wherein a force exerted by the dust cup biasing mechanism 600 is insufficient to overcome a force exerted by the stop biasing mechanism 604.

The removal release 411 removably couples the premotor filter chamber 412 to the cleaner body 402. As shown, the removal release 411 is pivotally coupled to the cleaner body 402 such that the removal release 411 is transitionable between a latching position and a release position. The removal release 411 includes an actuation end 608 and a latch end 610, the actuation end 608 being opposite the latch end 610. The latch end 610 defines a latch 612 configured to engage a catch 614 defined in the premotor filter chamber 412. The removal release 411 may be biased toward the latching position such that the latch 612 engages the catch 614.

As also shown, when the removal release 411 is in the latching position, the removal release 411 is configured to engage the stop 602, preventing the stop 602 from sliding in a direction away from the pivot point 504. In other words, when the removal release 411 is in the latching position, sliding movement of the stop 602 is substantially prevented (e.g., sliding movement of the stop 602 is insufficient to allow the dust cup 406 to transition to the removal position). When the removal release 411 transitions to the release position, the latch 612 disengages the catch 614, the premotor filter chamber 412 may be decoupled from the cleaner body 402, and the stop 602 can slide in a direction away from the pivot point 504. For example, when the removal release 411 is in the release position (or when the premotor filter chamber 412 is decoupled from the cleaner body 402), pivotal movement of the dust cup 406 from the emptying position toward the removal position slides the stop 602 away from the pivot point 504 and toward the retracted position of the stop 602. When the stop 602 is in the retracted position, the stop 602 may prevent the removal release 411 from transitioning back to the latching position if the premotor filter chamber 412 is coupled to the cleaner body 402. As such, when the dust cup 406 is in the removal position, the dust cup 406 may generally be described as being removable from the cleaner body 402.

When the dust cup 406 is transitioned to the removal position, the dust cup 406 may be configured to be retained in the removal position until a user exerts a force on the dust cup 406 to transition the dust cup 406 towards the emptying position. For example, the dust cup 406 may include a dust cup stopping face 618 that is configured to engage (e.g., contact) a stop stopping face 620 of the stop 602, wherein engagement between the stopping faces 618 and 620 resists rotational movement of the dust cup 406 from the removal position towards the emptying position.

When the removal release 411 is in the release position and/or the dust cup 406 is in the removal position, the premotor filter chamber 412 and dust cup 406 can be removed from the cleaner body 402. For example, the premotor filter chamber 412 and dust cup 406 may be removed from the cleaner body 402 in response to a force exerted in a direction generally parallel to the longitudinal axis 405 of the cleaner body 402. Once removed, the premotor filter 410 may be removed (e.g., for cleaning or replacement).

An example of a surface cleaning apparatus, consistent with the present disclosure, may include a cleaner body and a dust cup coupled to the cleaner body, the dust cup being configured to pivot between at least three indexed positions.

In some instances, the surface cleaning apparatus may further include a filter chamber removably coupled to the cleaner body. In some instances, the dust cup may be pivotally coupled to the filter chamber. In some instances, the at least three indexed positions may include a closed position, an emptying position, and a removal position, the dust cup being configured to transition from the closed position to the emptying position and to transition from the emptying position to the removal position. In some instances, when the dust cup is in the removal position, the dust cup may be removable from the cleaner body. In some instances, the surface cleaning apparatus may further include a slidable stop configured to retain the dust cup in the emptying position. In some instances, the slidable stop may be configured to slide in response to pivotal movement of the dust cup from the emptying position toward the removal position. In some instances, the surface cleaning apparatus may further include a removal release pivotally coupled to the cleaner body, the removal release being configured to transition between a latching position and a releasing position, wherein, when the removal release is in the latching position, sliding movement of the slidable stop is substantially prevented.

An example of a vacuum cleaner, consistent with the present disclosure, may include a cleaner body having a handle and an inlet, a suction motor fluidly coupled to the inlet, a premotor filter chamber removably coupled to the cleaner body and fluidly coupled to the suction motor, and a dust cup fluidly coupled to the suction motor and pivotally coupled to the premotor filter chamber.

In some instances, the dust cup may be configured to pivot between at least three indexed positions. In some instances, the at least three indexed positions may include a closed position, an emptying position, and a removal position, the dust cup being configured to transition from the closed position to the emptying position and to transition from the emptying position to the removal position. In some instances, when the dust cup is in the removal position, the premotor filter chamber may be removable from the cleaner body. In some instances, the vacuum cleaner may further include a slidable stop slidably coupled to the premotor filter chamber and configured to retain the dust cup in the emptying position. In some instances, the slidable stop may be configured to slide in response to pivotal movement of the dust cup from the emptying position toward the removal position. In some instances, the vacuum cleaner may further include a removal release pivotally coupled to the cleaner body, the removal release being configured to transition between a latching position and a releasing position, wherein, when the removal release is in the latching position, sliding movement of the slidable stop is substantially prevented.

Another example of a vacuum cleaner, consistent with the present disclosure, may include a cleaner body having a handle and an inlet, the inlet being opposite the handle along a longitudinal axis of the cleaner body, a suction motor fluidly coupled to the inlet, a premotor filter chamber removably coupled to the cleaner body and fluidly coupled to the suction motor, and a dust cup fluidly coupled to the suction motor and pivotally coupled to the premotor filter chamber, the dust cup being configured to pivot between at least a closed position, an emptying position, and a removal position, the dust cup being further configured to transition from the closed position to the emptying position and to transition from the emptying position to the removal position.

In some instances, when the dust cup is in the removal position, the premotor filter chamber may be removable from the cleaner body. In some instances, the vacuum cleaner may further include a slidable stop slidably coupled to the premotor filter chamber and configured to retain the dust cup in the emptying position. In some instances, the slidable stop may be configured to slide in response to pivotal movement of the dust cup from the emptying position toward the removal position. In some instances, the vacuum cleaner may further include a removal release pivotally coupled to the cleaner body, the removal release being configured to transition between a latching position and a releasing position, wherein, when the removal release is in the latching position, sliding movement of the slidable stop is substantially prevented.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface cleaning apparatus comprising:

a cleaner body having a handle and an inlet;

a dust cup removably coupled to the cleaner body and configured to pivot about a pivot point between at least three indexed positions and configured to be selectively retained at each of the at least three indexed positions, the at least three indexed positions including:

a first position, when in the first position, the dust cup is fluidly coupled to the inlet such that an airflow path extends from the inlet and into the dust cup;

a second position, when transitioning from the first position to the second position, the dust cup pivots away from the inlet such that, when in the second position, the dust cup is fluidly decoupled from the inlet by exposing an inlet end of the dust cup; and a third position;

a dust cup spring configured to urge the dust cup from the first position towards the second position;

a slidable stop configured to prevent unintended movement of the dust cup between the second position and the third position, wherein the slidable stop is caused to slide in response to a user exerted force on the dust cup, sliding of the slidable stop allows the dust cup to transition between the second position and the third position, the user exerted force causing the dust cup to pivot; and a stop spring configured to urge the slidable stop in a direction of the pivot point, wherein a dust cup spring biasing force of the dust cup spring is:

less than a stop spring biasing force of the stop spring such that unintended movement of the dust cup from the second position to the third position is prevented; and configured such that unintended movement of the dust cup from the second position to the first position is prevented.

2. The surface cleaning apparatus of claim 1 further comprising a filter chamber removably coupled to the cleaner body.

3. The surface cleaning apparatus of claim 2, wherein the dust cup is pivotally coupled to the filter chamber.

4. The surface cleaning apparatus of claim 1 further comprising a removal release pivotally coupled to the cleaner body, the removal release being configured to transition between a latching position and a releasing position, wherein, when the removal release is in the latching position, sliding movement of the slidable stop is substantially prevented.

5. A vacuum cleaner comprising:

a cleaner body having a handle and an inlet;

a suction motor configured to be fluidly coupled to the inlet;

a premotor filter chamber removably coupled to the cleaner body and configured to be fluidly coupled to the suction motor;

a dust cup configured to be fluidly coupled to the suction motor and the inlet, the dust cup extending from an inlet end to an outlet end, wherein an airflow path enters the dust cup at the inlet end and exits the dust cup at the outlet end, the dust cup being pivotally coupled to the premotor filter chamber at a pivot point, the pivot point being at the outlet end of the dust cup, wherein the dust cup is configured to selectively pivot between:

a first position, when in the first position, the dust cup is fluidly coupled to the inlet such that the airflow path extends from the inlet and into the dust cup;

a second position, when transitioning from the first position to the second position, the dust cup pivots away from the inlet such that, when in the second position, the dust cup is fluidly decoupled from the inlet by exposing an inlet end of the dust cup; and a third position;

a dust cup spring configured to urge the dust cup from the first position towards the second position;

a slidable stop slidably coupled to the premotor filter chamber and configured to retain the dust cup in the second position, wherein the slidable stop is configured to slide in response to pivotal movement of the dust cup from the second position toward the third position; and a stop spring configured to urge the slidable stop in a direction of the pivot point, wherein a dust cup spring biasing force of the dust cup spring is:

less than a stop spring biasing force of the stop spring such that unintended movement of the dust cup from the second position to the third position is prevented; and configured such that unintended movement of the dust cup from the second position to the first position is prevented.

6. The vacuum cleaner of claim 5 further comprising a removal release pivotally coupled to the cleaner body, the removal release being configured to transition between a latching position and a releasing position, wherein, when the removal release is in the latching position, sliding movement of the slidable stop is substantially prevented.

7. A vacuum cleaner comprising:

a cleaner body having a handle and an inlet, the inlet being opposite the handle along a longitudinal axis of the cleaner body;

a suction motor configured to be fluidly coupled to the inlet;

a dust cup configured to be fluidly coupled to the suction motor and the inlet, the dust cup extending from an inlet end to an outlet end, wherein an airflow path enters the dust cup at the inlet end and exits the dust cup at the outlet end, the dust cup being configured to pivot relative to the cleaner body at a pivot point, the pivot point being at the outlet end of the dust cup, the dust cup being configured to selectively pivot between at least:

a first position, when in the first position, the dust cup is fluidly coupled to the inlet such that the airflow path extends from the inlet and into the dust cup;

a second position, when transitioning from the first position to the second position, the dust cup pivots away from the inlet such that, when in the second position, the dust cup is fluidly decoupled from the inlet by exposing an inlet end of the dust cup; and a third position;

a dust cup spring configured to urge the dust cup from the first position towards the second position;

a slidable stop configured to prevent unintended movement of the dust cup between the second position and the third position, wherein the slidable stop is caused to slide in response to a user exerted force on the dust cup, sliding of the slidable stop allows the dust cup to transition between the second position and the third position, the user exerted force causing the dust cup to pivot; and a stop spring configured to urge the slidable stop in a direction of the pivot point, wherein a dust cup spring biasing force of the dust cup spring is:

less than a stop spring biasing force of the stop spring such that unintended movement of the dust cup from the second position to the third position is prevented; and configured such that unintended movement of the dust cup from the second position to the first position is prevented.

8. The vacuum cleaner of claim 7 further comprising a removal release pivotally coupled to the cleaner body, the removal release being configured to transition between a latching position and a releasing position, wherein, when the removal release is in the latching position, sliding movement of the slidable stop is substantially prevented.

* * * * *